US011649416B2

(12) United States Patent
Boardman et al.

(10) Patent No.: US 11,649,416 B2
(45) Date of Patent: May 16, 2023

(54) AQUEOUS SPRAY COMPOSITION COMPRISING SILICONE AND PERFUME MICROEMULSIONS

(71) Applicant: Conopco, Inc., Englewood Cliffs, NJ (US)

(72) Inventors: Christopher Boardman, Denbigh (GB); Karl Burgess, Prenton (GB); Mark Anthony Carus, Little Sutton (GB); Julie Cullen, Wallasey (GB)

(73) Assignee: Conopco, Inc., Englewood Cliffs, NJ (US)

( * ) Notice: Subject to any disclaimer, the term of this patent is extended or adjusted under 35 U.S.C. 154(b) by 409 days.

(21) Appl. No.: 16/754,829

(22) PCT Filed: Oct. 2, 2018

(86) PCT No.: PCT/EP2018/076840
§ 371 (c)(1),
(2) Date: Apr. 9, 2020

(87) PCT Pub. No.: WO2019/072647
PCT Pub. Date: Apr. 18, 2019

(65) Prior Publication Data

US 2020/0240074 A1 Jul. 30, 2020

(30) Foreign Application Priority Data

Oct. 13, 2017 (EP) ..... 17196284

(51) Int. Cl.

| | |
|---|---|
| ***C11D 9/36*** | (2006.01) |
| ***C11D 3/37*** | (2006.01) |
| ***C11D 3/50*** | (2006.01) |
| ***C11D 11/00*** | (2006.01) |
| ***C11D 17/00*** | (2006.01) |

(52) U.S. Cl.
CPC ..... *C11D 3/373* (2013.01); *C11D 3/50* (2013.01); *C11D 11/0017* (2013.01); *C11D 17/0043* (2013.01); *D06M 2200/50* (2013.01)

(58) Field of Classification Search
CPC ..... C11D 17/0021; C11D 17/0043; C11D 17/0013; C11D 17/0017; C11D 9/36; C11D 11/0017; C11D 9/442
See application file for complete search history.

(56) References Cited

U.S. PATENT DOCUMENTS

| | | | |
|---|---|---|---|
| 4,917,303 | A | 4/1990 | Maas |
| 4,991,778 | A | 2/1991 | Maas et al. |
| 5,111,971 | A | 5/1992 | Winer |
| 5,234,166 | A | 8/1993 | Foster et al. |
| 5,294,025 | A | 3/1994 | Foster |
| 5,397,060 | A | 3/1995 | Maas et al. |
| 5,534,165 | A | 7/1996 | Pilosof et al. |
| 5,626,259 | A | 5/1997 | Maas et al. |
| 5,730,006 | A | 3/1998 | Conley |
| 5,783,541 | A | 7/1998 | Tack |
| 5,789,368 | A | 8/1998 | You et al. |
| 5,942,217 | A | 8/1999 | Woo et al. |
| 5,955,093 | A | 9/1999 | Woo |
| 5,968,404 | A | 10/1999 | Trinh |
| 5,997,759 | A | 12/1999 | Trinh |
| 6,033,679 | A | 3/2000 | Woo et al. |
| 6,194,470 | B1 | 2/2001 | Lutz et al. |
| 6,416,558 | B1 | 7/2002 | Ona et al. |
| 6,446,882 | B1 | 9/2002 | Dukes |
| 6,491,840 | B1 | 12/2002 | Frankenbach et al. |
| 6,495,058 | B1 | 12/2002 | Frankenbach et al. |
| 6,528,013 | B1 | 4/2003 | Trinh et al. |
| 6,645,392 | B2 | 11/2003 | Frankenbach et al. |
| 7,012,053 | B1 | 3/2006 | Barnabas et al. |
| 7,341,674 | B1 * | 3/2008 | Trinh ..... D06M 15/19 106/18.32 |
| 9,243,213 | B1 | 1/2016 | Vetter et al. |
| 9,365,803 | B2 | 6/2016 | Vetter et al. |
| 9,610,239 | B2 | 4/2017 | Feng et al. |
| 2002/0115581 | A1 | 8/2002 | DuVal |
| 2002/0115584 | A1 | 8/2002 | Ongena |
| 2002/0148994 | A1 | 10/2002 | McGee |
| 2002/0165109 | A1 | 11/2002 | Cropper et al. |
| 2003/0035748 | A1 | 2/2003 | Trinh et al. |
| 2003/0068375 | A1 | 4/2003 | Wright et al. |
| 2003/0071075 | A1 | 4/2003 | Frankenbach et al. |
| 2003/0098368 | A1 | 5/2003 | Foster |

(Continued)

FOREIGN PATENT DOCUMENTS

| | | |
|---|---|---|
| BR | 102015027601 | 5/2017 |
| CN | 1195266 | 10/1998 |

(Continued)

OTHER PUBLICATIONS

Liao Wensheng, English Translation of Exhibit 1: "Liquid Detergents, New Raw Materials and New Formulations", p. 128, Chemical Industry Press, Jan. 2001 (4 pages).
"Milk and Dairy Product Engineering Technology"; Jan. 2016; 192; China Light Industry Press.
Wu Weixiong et al.; "Usage and Maintenance of Modern Agricultural Plant Protection Machinery"; 2010; 51-52; Atomic Energy Press.
Search Report and Written Opinion in PCTEP2018076840; dated Dec. 10, 2018.
Search Report and Written Opinion in PCTEP2018076839.
Search Report and Written Opinion in EP17196284; dated Mar. 27, 2018.
Search Report and Written Opinion in EP1796275; dated Apr. 19, 2018.

(Continued)

*Primary Examiner* — Charles I Boyer
(74) *Attorney, Agent, or Firm* — Carter, DeLuca & Farrell LLP; George Likourezos; Bret P. Shapiro

(57) ABSTRACT

An aqueous fabric spray composition, comprising: a. 1-10 w.t. % silicone, wherein the silicone is in the form of an emulsion, the emulsion having a particle size of 1 nm to 150 nm b. Free perfume, having an emulsion particle size of 1 nm to 30 μm.

11 Claims, No Drawings

(56) References Cited

U.S. PATENT DOCUMENTS

| | | | | |
|---|---|---|---|---|
| 2003/0100461 | A1 | 5/2003 | Catlin | |
| 2003/0100463 | A1 | 5/2003 | Delamarche | |
| 2003/0146405 | A1 | 8/2003 | Frankenbach et al. | |
| 2003/0201339 | A1 | 10/2003 | Foster et al. | |
| 2003/0209686 | A1 | 11/2003 | Frankenbach et al. | |
| 2003/0215417 | A1 | 11/2003 | Uchiyama et al. | |
| 2003/0216488 | A1 | 11/2003 | Uchiyama et al. | |
| 2004/0053810 | A1 | 3/2004 | Tully et al. | |
| 2004/0127463 | A1 | 7/2004 | Trinh | |
| 2004/0149837 | A1 | 8/2004 | Foster | |
| 2005/0089540 | A1 | 4/2005 | Uchiyama et al. | |
| 2005/0113282 | A1 | 5/2005 | Parekh et al. | |
| 2006/0003913 | A1 | 1/2006 | Boutique et al. | |
| 2009/0050838 | A1 | 2/2009 | Doneva et al. | |
| 2009/0178211 | A1 | 7/2009 | Wahl et al. | |
| 2009/0178212 | A1 | 7/2009 | Wahl et al. | |
| 2010/0098644 | A1* | 4/2010 | Vlad | A61Q 13/00 424/59 |
| 2011/0186467 | A1 | 8/2011 | Denome | |
| 2011/0272494 | A1 | 11/2011 | Richardson et al. | |
| 2011/0275553 | A1 | 11/2011 | Leopold et al. | |
| 2012/0181305 | A1 | 7/2012 | West et al. | |
| 2012/0183605 | A1 | 7/2012 | Arnold et al. | |
| 2013/0139327 | A1 | 6/2013 | Sieben et al. | |
| 2013/0273277 | A1 | 10/2013 | Lee et al. | |
| 2013/0306757 | A1 | 11/2013 | Parmentier | |
| 2013/0306767 | A1 | 11/2013 | Becker et al. | |
| 2014/0189962 | A1 | 7/2014 | Tovar Pescador et al. | |
| 2015/0158645 | A1 | 6/2015 | Meier et al. | |
| 2015/0158646 | A1 | 6/2015 | Meier et al. | |
| 2015/0252305 | A1 | 9/2015 | Souter | |
| 2015/0252306 | A1 | 9/2015 | Souter | |
| 2015/0292141 | A1 | 10/2015 | Behr | |
| 2016/0024435 | A1* | 1/2016 | Vetter | C11D 7/5022 510/528 |
| 2016/0108339 | A1* | 4/2016 | Feng | A61K 8/8141 264/4.7 |
| 2016/0215238 | A1* | 7/2016 | Vetter | C11D 3/042 |
| 2017/0001208 | A1 | 1/2017 | Barenhoff et al. | |
| 2017/0066999 | A1 | 3/2017 | Brandt-Sanz | |
| 2017/0067000 | A1 | 3/2017 | Brandt-Sanz | |

FOREIGN PATENT DOCUMENTS

| | | | |
|---|---|---|---|
| CN | 1278033 | | 12/2000 |
| CN | 1332787 | | 1/2002 |
| CN | 1384895 | | 12/2002 |
| CN | 1498137 | | 5/2004 |
| CN | 1631549 | | 6/2005 |
| CN | 101104463 | | 1/2008 |
| CN | 101142357 | | 3/2008 |
| CN | 101146724 | | 3/2008 |
| CN | 101802293 | | 8/2010 |
| CN | 102260604 | | 11/2011 |
| CN | 103748204 | | 4/2014 |
| CN | 104582859 | | 4/2015 |
| CN | 104661646 | | 5/2015 |
| CN | 106661514 | | 5/2017 |
| CN | 106164358 | | 5/2018 |
| CN | 106574214 | | 4/2020 |
| EP | 0988365 | | 5/2005 |
| EP | 988364 | | 8/2005 |
| EP | 2196531 | | 6/2010 |
| EP | 2216394 | | 11/2010 |
| EP | 2196531 | | 9/2014 |
| EP | 2933101 | | 10/2015 |
| ES | 2016450 | | 11/1990 |
| GB | 2270930 | A | 3/1994 |
| JP | 1029438 | | 1/1989 |
| JP | 2000063204 | | 2/2000 |
| NZ | 228775 | | 10/1990 |
| WO | WO9608555 | | 3/1996 |
| WO | WO9856888 | | 12/1998 |
| WO | WO9856890 | | 12/1998 |
| WO | WO9955814 | | 11/1999 |
| WO | WO9955815 | | 11/1999 |
| WO | WO9955952 | | 11/1999 |
| WO | WO9955953 | | 11/1999 |
| WO | WO0024856 | | 5/2000 |
| WO | WO0107561 | | 2/2001 |
| WO | WO0116266 | | 3/2001 |
| WO | WO0131113 | | 5/2001 |
| WO | WO2001061100 | | 8/2001 |
| WO | WO0215663 | | 2/2002 |
| WO | WO0226896 | | 4/2002 |
| WO | WO0240623 | | 5/2002 |
| WO | WO02076624 | | 10/2002 |
| WO | WO03025108 | | 3/2003 |
| WO | WO03057813 | | 3/2003 |
| WO | WO03045813 | | 6/2003 |
| WO | WO03089561 | | 10/2003 |
| WO | WO2005025626 | | 3/2005 |
| WO | WO2008034594 | | 3/2008 |
| WO | WO2008073299 | | 6/2008 |
| WO | WO2009036277 | | 3/2009 |
| WO | WO2011009100 | | 1/2011 |
| WO | WO2013158364 | | 10/2013 |
| WO | WO14003180 | | 1/2014 |
| WO | WO2014016144 | | 1/2014 |
| WO | WO2014026855 | | 2/2014 |
| WO | WO2014026856 | | 2/2014 |
| WO | WO2015117625 | | 8/2015 |
| WO | WO2015134829 | | 9/2015 |
| WO | WO2017025426 | | 2/2017 |
| WO | WO2018024511 | | 2/2018 |
| WO | WO2018024798 | | 2/2018 |
| WO | 2019072646 | A1 | 4/2019 |
| WO | WO2000024851 | | 5/2020 |

OTHER PUBLICATIONS

Search Report and Written Opinion in EP17204518; dated Jun. 11, 2018.

Search Report and Written Opinion in EP17204524.

Search Report and Written Opinion in 18175375.

Search Report and Written Opinion in EP15180622; dated Feb. 1, 2016.

Search Report and Written Opinion in EP15180624 ; dated Jan. 22, 2016.

Search Report and Written Opinion in EP15180618; dated Mar. 1, 2016.

Search Report and Written Opinion in EP15180621; dated Feb. 1, 2016.

Search Report and Written Opinion in PCTEP2016066036; dated Sep. 8, 2016.

Search Report & Written Opinion in PCTEP2016066043; dated Sep. 14, 2016.

Search Report and Written Opinion in PCTEP2016068639; dated Oct. 5, 2016.

Search Report and Written Opinion in EP16183128; dated Feb. 13, 2017.

TS800 Trigger Sprayers; TS800 Trigger Sprayers Mead Westvaco Corporation; Nov. 2013; Retrieved from the Internet: https://www.westrock.com/en/-/media/pdf/dispensers/one-pager/ts800onepagerl 1 2013.pdf Retrieved on Feb. 16, 2017 pp. 1-2 XP002767423.

Search Report and Written Opinion in EP16193715; dated Mar. 17, 2017.

Ghasem et al.; Background on Sprays and Their Production ; Industrial Sprays and Atomization Design Analysis and Applications; 2002; pp. 7-33; XP009195118; Chapter 2; Springer.

Search Report and Written Opinion in PCTEP2017068512; dated Oct. 5, 2017.

Search Report and Written Opinion in PCTEP2017069580; dated Nov. 16, 2017.

Search Report and Written Opinion in EP17196293; dated Mar. 22, 2018.

Search Report and Written Opinion in EP17196289; dated Mar. 27, 2018.

(56) References Cited

OTHER PUBLICATIONS

Search Report and Written Opinion in PCTEP2018076838; dated Dec. 10, 2018.
Search Report and Written Opinion in PCTEP2018076841; dated Dec. 10, 2018.
Search Report and Written Opinion in PCTEP2018076836; dated Dec. 7, 2018.
Search Report and Written Opinion in PCTEP2018082740.; dated Jan. 29, 2019.
Search Report and Written Opinion in PCTEP2018082741.; dated Jan. 30, 2019.
Written Opinion 2 in PCTEP2018076836; dated Aug. 23, 2019.
Search Report and Written Opinion in PCTEP2018076838; dated Dec. 8, 2018.
IPRP in PCT/EP2018/076836; IPRP in PCT/EP2018/076836; Jan. 7, 2020.
IPRP2 in PCTEP2018082740; Feb. 12, 2020.
IPRP in PCTEP2018076841; Jan. 24, 2020.
X; Regulation No. 1272/2008 of the European Parliament and of the Council; L 353; Dec. 16, 2008; pp. 1-14.
X; Technical Report 191220 LAS02720EP-IX01; x; x; x; x.
Unilever PLC; Water-Soluble Package, Application No. EP15180624.7, filed Aug. 11, 2015; Water-Soluble Package, Application No. EP15180624.7, filed Aug. 11, 2015; Aug. 11, 2015; 18 pages.
X; Regulation No. 348/2004 of the European Parliament and of the Council; 2004RO648-EN-01.06.2015-007.001; Mar. 31, 2004; pp. 1-54.
X; Regulation No. 1297/2014 of the European Parliament and of the Council; L 350; Dec. 5, 2014; pp. 1-4; x.
IPRP2 in PCTEP2018082741; Feb. 7, 2020.

* cited by examiner

AQUEOUS SPRAY COMPOSITION COMPRISING SILICONE AND PERFUME MICROEMULSIONS

RELATED APPLICATIONS

This application is a national phase filing under 35 USC 371 of International Application No. PCT/EP2018/076840, filed on Oct. 2, 2018, which claims priority from European Patent Application No. 17196284.8, filed Oct. 13, 2017, the contents of which are incorporated herein in their entirety for all purposes.

FIELD OF THE INVENTION

The field of the present invention is fabric sprays.

BACKGROUND OF THE INVENTION

Consumers have increasingly busy lives, with limited time to do their laundry. On the other hand, roughly 40% of garments which go through the laundry process are not dirty and could be re-worn. This practice leads to un-necessary use of water which can be problematic particularly in water scarce regions of the world.

Various fabric re-fresh sprays have been disclosed previously. EP1495102 discloses a composition to provide controlled release of an active material. WO 200161100 discloses a composition for controlling wrinkles in fabric. However these compositions are only concerned with particular aspects of refresh and are not sufficient coping mechanism to provide the consumers with the confidence to re-wear.

There is a need for a consumer product to rejuvenate garments and return them to a 'just washed state', thereby provide the consumers with the confidence to re-wear a garment. The consumer cues for 'just washed state' are a synergistic combination of the look and feel of a garment. When looking for rejuvenation consumers desire the garments to return to the look and feel of a newly purchased state.

SUMMARY OF THE INVENTION

According to one aspect of the present invention there is provided an aqueous fabric spray composition, comprising:

a. 1-10 w.t. % silicone, wherein the silicone is in the form of an emulsion, the emulsion having a particle size of 1 nm to 150 nm b. Free perfume, having an emulsion particle size of 1 nm to 30 um According to another aspect of the present invention there is provided a method of rejuvenating fabric or returning clothes to a 'just washed' state, comprising the step of spraying the composition according to the present invention onto the fabric or clothes.

According to another aspect of the present invention there is provided a use of the composition according to the present invention, to rejuvenate clothes or to return clothes to a 'just washed state'.

Compositions according to the present invention provide benefits such as shape restoration, a thicker, newer feel to the fabric, enhanced fragrance, protection against future creases, fibre protection and reduction in the appearance of fibrils.

The ability to remove creases, without heat is particularly beneficial to compositions comprising volatile perfume ingredients, having a low boiling point. These volatile ingredients are often a cue for freshness and it is desirable for these to last on the fabric for as long as possible. Ironing at for example 230 degrees Centigrade would lead to the evaporation of many of these perfume ingredients.

DETAILED DESCRIPTION OF THE INVENTION

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about". Numerical ranges expressed in the format "from x to y" are understood to include x and y. When for a specific feature multiple preferred ranges are described in the format "from x to y", it is understood that all ranges combining the different endpoints are also contemplated.

Aqueous Compositions

The compositions of the present invention are aqueous fabric sprays. Preferably at least 60 w.t. % of the composition is water, more preferably at least 70 w.t. %.

Silicone

The compositions of the present invention comprise silicone.

Silicone may be present at a level selected from: less than 10%, less than 8%, and less than 6%, by weight of the spray composition. Silicone may be present at a level selected from: more than 0.5%, more than 1%, and more than 1.5%, by weight of the spray composition. Suitably silicone is present in the spray composition in an amount selected from the range of from about 0.5% to about 10%, preferably from about 0.5% to about 8%, more preferably from about 0.5% to about 6%, by weight of the garment refreshing composition.

Silicones and their chemistry are described in, for example in The Encyclopaedia of Polymer Science, volume 11, p765.

Silicones suitable for the present invention are fabric softening silicones. Non-limiting examples of such silicones include:

Non-functionalised silicones such as polydimethylsiloxane (PDMS),

Functionalised silicones such as alkyl (or alkoxy) functionalised, alkylene oxide functionalised, amino functionalised, phenyl functionalised, hydroxy functionalised, polyether functionalised, acrylate functionalised, siliconhydride functionalised, carboxy functionalised, phosphate functionalised, sulphate functionalised, phosphonate functionalised, sulphonic functionalised, betaine functionalised, quarternized nitrogen functionalised and mixtures thereof.

Copolymers, graft co-polymers and block co-polymers with one or more different types of functional groups such as alkyl, alkylene oxide, amino, phenyl, hydroxy, polyether, acrylate, siliconhydride, carboxy, phosphate, sulphonic, phosphonate, betaine, quarternized nitrogen and mixtures thereof.

Suitable non-functionalised silicones have the general formula:

$$R_1—Si(R_3)_2—O—[—Si(R_3)_2—O—]_x—Si(R_3)_2—R_2$$

$R_1$=hydrogen, methyl, methoxy, ethoxy, hydroxy, propoxy, and aryloxy group.

$R_2$=hydrogen, methyl, methoxy, ethoxy, hydroxy, propoxy, and aryloxy group.

$R_3$=alkyl, aryl, hydroxy, or hydroxyalkyl group, and mixtures thereof

Suitable functionalised silicones may be anionic, cationic, or non-ionic functionalised silicones.

The functional group(s) on the functionalised silicones are preferably located in pendent positions on the silicone i.e. the composition comprises functionalised silicones wherein the functional group(s) are located in a position other than at the end of the silicone chain. The terms 'terminal position' and 'at the end of the silicone chain' are used to indicate the terminus of the silicone chain.

When the silicones are linear in nature, there are two ends to the silicone chain. In this case the anionic silicone preferably contains no functional groups located on a terminal position of the silicone.

When the silicones are branched in nature, the terminal position is deemed to be the two ends of the longest linear silicone chain. Preferably no functional group(s) are located on the terminus of the longest linear silicone chain.

Preferred functionalised silicones are those that comprise the anionic group at a mid-chain position on the silicone. Preferably the functional group(s) of the functionalised silicone are located at least five Si atoms from a terminal position on the silicone. Preferably the functional groups are distributed randomly along the silicone chain.

For best performance, it is preferred that the silicone is selected from: carboxy functionalised silicone; anionic functionalised silicone; non-functionalised silicone; and mixtures thereof. More preferably, the silicone is selected from: carboxy functionalised silicone; amino functionalised silicone; polydimethylsiloxane (PDMS) and mixtures thereof. Preferred features of each of these materials are outlined herein. Most preferably the silicone is selected from amino functionalised silicones; polydimethylsiloxane (PDMS) and mixtures thereof.

A carboxy functionalised silicone may be present as a carboxylic acid or an carbonate anion and preferably has a carboxy group content of at least 1 mol % by weight of the silicone polymer, preferably at least 2 mol %. Preferably the carboxy group(s) are located in a pendent position, more preferably located at least five Si atoms from a terminal position on the silicone. Preferably the carboxy groups are distributed randomly along the silicone chain. Examples of suitable carboxy functional silicones include FC 220 ex. Wacker Chemie and X22-3701E ex. Shin Etsu.

An amino functionalised silicone means a silicone containing at least one primary, secondary or tertiary amine group, or a quaternary ammonium group. The primary, secondary, tertiary and/or quaternary amine groups are preferably located in a pendent position, more preferably located at least five Si atoms from a terminal position on the silicone. Preferably the amino groups are distributed randomly along the silicone chain. Examples of suitable amino functional silicones include FC222 ex. Wacker Chemie and EC218 ex. Wacker Chemie.

A polydimethylsiloxane (PDMS) polymer has the general formula:

$$R_1—Si(CH_3)_2—O—[—Si(CH_3)_2—O—]_x—Si(CH_3)_2—R_2$$

$R_1$=hydrogen, methyl, methoxy, ethoxy, hydroxy, propoxy, and aryloxy group.

$R_2$=hydrogen, methyl, methoxy, ethoxy, hydroxy, propoxy, and aryloxy group.

A suitable example of a PDMS polymer is E22 ex. Wacker Chemie.

The molecular weight of the silicone polymer is preferably from 1,000 to 500,000, more preferably from 2,000 to 250,000 even more preferably from 5,000 to 200,000.

The silicone of the present invention is in the form of an emulsion. Silicones are preferably emulsified prior to addition to the present compositions. Silicone compositions are generally supplied from manufacturers in the form of emulsions.

The average particle size of the emulsion is in the range from about 1 nm to 150 nm, preferably 1 nm to 100 nm. Alternatively, the particle size may preferably be in the range 55 nm to 150 nm, preferably 60 to 150 nm and more preferably 60 to 100 nm. This may be referred to as a micro emulsion. The particle size is measured as a volume mean diameter, D[4,3], this can be measured using a Malvern Mastersizer 2000 from Malvern instruments.

The particle size of the silicone emulsion will provides shape rejuvenation for the fabric.

Free Perfume

The compositions of the present invention comprises free perfume.

Free perfume may be present at a level selected from: less than 10%, less than 8%, and less than 5%, by weight of the spray composition. Free perfume may be present at a level selected from: more than 0.0001%, more than 0.001%, and more than 0.01%, by weight of the spray composition. Suitably free perfume is present in the spray composition in an amount selected from the range of from about 0.0001% to about 10%, preferably from about 0.001% to about 8%, more preferably from about 0.01% to about 5%, by weight of the garment refreshing composition.

Useful perfume components may include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products.

A wide variety of chemicals are known for perfume use including materials such as aldehydes, ketones, esters and the like. More commonly, naturally occurring plant and animal oils and exudates comprising complex mixtures of various chemical components are known for use as perfume, and such materials can be used herein. Typical perfumes can comprise e.g. woody/earthy bases containing exotic materials such as sandalwood oil, civet and patchouli oil. The perfume also can be of a light floral fragrance e.g. rose or violet extract. Further the perfume can be formulated to provide desirable fruity odours e.g. lime, limon or orange.

Particular examples of useful perfume components and compositions are anetole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, vertenex (para-tertiarybutyl cyclohexyl acetate), amyl cinnamic aldehyde, isoamyl salicylate, beta-caryophyllene, cedrene, cinnamic alcohol, couramin, dimethyl benzyl carbinyl acetate, ethyl vanillin, eugenol, iso-eugenol, flor acetate, heliotrophine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, veratraldehyde, alpha-cedrene, beta-cedrene, C15H24sesquiterpenes, benzophenone, benzyl salicylate, ethylene brassylate, galaxolide (1,3,4,6,7,8-hexahydro-4,6,6,7,8,8,-hexamethyl-cyclo-penta-gamma-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk ambrette, musk idanone, musk ketone, musk tibetine, musk xylol, aurantiol and phenylethyl phenyl acetate.

The free perfume compositions of the present compositions comprise blooming perfume ingredients. Blooming perfume components are defined by a boiling point less than 250° C. and a Log P or greater than 2.5. Preferably the free perfume compositions of the present invention comprise at least 10 w.t. % blooming perfume ingredients, more preferably at least 20 w.t. % blooming perfume ingredients, most preferably at least 25 w.t. % blooming perfume ingredients. Preferably the free perfume compositions of the present comprise less than 58 w.t. % blooming perfume ingredients, more preferably less than 50 w.t. % blooming perfume ingredients, most preferably less than 45 w.t. % blooming perfume ingredients. Suitably the free perfume compositions of the present compositions comprise 10 to 58 w.t. % blooming perfume ingredients, preferably 20 to 50 w.t. % blooming perfume ingredients, more preferably 25 to 45 w.t. % blooming perfume ingredients.

Examples of suitable blooming perfume ingredient include: Allo-ocimene, Allyl heptanoate, trans-Anethole, Benzyl butyrate, Camphene, Carvacrol, cis-3-Hexenyl tiglate, Citronellol, Citronellyl acetate, Citronellyl nitrile, Cyclohexylethyl acetate, Decyl Aldehyde (Capraldehyde), Dihydromyrcenol, Dihydromyrcenyl acetate, 3,7-Dimethyl-1-octanol, Fenchyl Acetate, Geranyl acetate, Geranyl formate, Geranyl nitrile, cis-3-Hexenyl isobutyrate, Hexyl Neopentanoate, Hexyl tiglate, alpha-Ionone, Isobornyl acetate, Isobutyl benzoate, Isononyl acetate, Isononyl alcohol, Isopulegyl acetate, Lauraldehyde, Linalyl acetate, Lorysia, D-limonene, Lymolene, (-)-L-Menthyl acetate, Methyl Chavicol (Estragole), Methyl n-nonly acetaldehyde, Methyl octyl acetaldehyde, Beta-Myrcene, Neryl acetate, Nonyl acetate, Nonaldehyde, Para-Cymene, alpha-Pinene, beta-Pinene, alpha-Terpinene, gamma-Terpinene, Terpineolene, alpha-Terpinyl acetate, Tetrahydrolinalool, Tetrahydromyrcenol, 2-Undecenal, Verdox (o-t-Butylcyclohexyl acetate), and Vertenex(4-tert.Butylcyclohexyl acetate).

Other useful perfume ingredients include substantive perfume components. Substantive perfume components are defined by a boiling point greater than 250° C. and a Log P greater than 2.5. Preferably the free perfume composition further comprises substantive perfume ingredients.

Boiling point is measured at standard pressure (760 mm Hg). Preferably a perfume composition will comprise a mixture of blooming and substantive perfume components. The perfume composition may comprise other perfume components.

The log P of many perfume ingredients have been reported; for example, the Pomona92 database, available from Daylight Chemical Information Systems, Inc. (Daylight CIS), Irvine, Calif., contains many, along with citations to the original literature. However, the log P values are most conveniently calculated by the "CLOGP" program, also available from Daylight CIS. This program also lists experimental log P values when they are available in the Pomona92 database. The "calculated log p" (ClogP) is determined by the fragment approach of Hansch and Leo (cf., A Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are used instead of the experimental log P values in the selection of perfume ingredients herein.

It is commonplace for a plurality of perfume components to be present in a free oil perfume composition. In the compositions for use in the present invention it is envisaged that there will be three or more, preferably four or more, more preferably five or more, most preferably six or more different perfume components. An upper limit of 300 perfume components may be applied.

The free perfume of the present invention is in the form of an emulsion. The particle size of the emulsion can be in the range from about 1 nm to 30 microns and preferably from about 100 nm to about 20 microns. The particle size is measured as a volume mean diameter, D[4,3], this can be measured using a Malvern Mastersizer 2000 from Malvern instruments.

Without wishing to be bound by theory, it is believed that the free perfumes of this emulsion particle size will interact with the silicone emulsion to provide improved perfume longevity on the items being sprayed.

Free oil perfume forms an emulsion in the present compositions. The emulsions may be formed outside of the composition or in situ. When formed in situ, at least one emulsifier is preferably added with the free oil perfume to stabilise the emulsion. Preferably the emulsifier is anionic or non-ionic. Examples suitable anionic emulsifiers for the free oil perfume are alkylarylsulphonates, e.g., sodium dodecylbenzene sulphonate, alkyl sulphates e.g., sodium lauryl sulphate, alkyl ether sulphates, e.g., sodium lauryl ether sulphate nEO, where n is from 1 to 20 alkylphenol ether sulphates, e.g., octylphenol ether sulphate nEO where n is from 1 to 20, and sulphosuccinates, e.g., sodium dioctylsulphosuccinate. Examples of suitable nonionic surfactants used as emulsifiers for the free oil perfume are alkylphenol ethoxylates, e.g., nonylphenol ethoxylate nEO, where n is from 1 to 50, alcohol ethoxylates, e.g., lauryl alcohol nEO, where n is from 1 to 50, ester ethoxylates, e.g., polyoxyethylene monostearate where the number of oxyethylene units is from 1 to 30 and PEG-40 hydrogenated castor oil.

Malodour Ingredients

Compositions of the present invention preferably comprise anti-malodour ingredient(s). Malodour ingredients maybe in addition to traditional free perfume ingredients.

Anti-malodour agent may be present at a level selected from: less than 20%, less than 10%, and less than 5%, by weight of the garment refreshing composition. Suitably anti-malodour agent is present in the garment refreshing composition in an amount selected from the range of from about 0.01% to about 5%, preferably from about 0.1% to about 3%, more preferably from about 0.5% to about 2%, by weight of the garment refreshing composition.

Any suitable anti-malodour agent may be used. Indeed, an anti-malodour effect may be achieved by any compound or product that is effective to "trap", "absorb" or "destroy" odour molecules to thereby separate or remove odour from the garment or act as a "malodour counteractant".

The odour control agent may be selected from the group consisting of: uncomplexed cyclodextrin; odour blockers; reactive aldehydes; flavanoids; zeolites; activated carbon; a mixture of zinc ricinoleate or a solution thereof and a substituted monocyclic organic compound; and mixtures thereof.

As noted above, a suitable anti-malodour agent is cyclodextrin, suitably water soluble uncomplexed cyclodextrin. Suitably cyclodextrin is present at a level selected from 0.01% to 5%, 0.1% to 4%, and 0.5% to 2% by weight of the garment refreshing composition.

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings.

Preferably, the cyclodextrins are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a —$CH_2$—CH(OH)—$CH_3$ or a —$CH_2CH_2$—OH group; branched cyclodextrins such as maltose-bonded cyclodextrins; cationic cyclodextrins such as those containing 2-hydroxy-3-(dimethylamino)propyl ether, wherein R is $CH_2$—CH(OH)—$CH_2$—$N(CH_3)_2$ which is cationic at low pH; quaternary ammonium, e.g., 2-hydroxy-3-(trimethylammonio)propyl ether chloride groups, wherein R is $CH_2$—CH(OH)—$CH_2$—N+$(CH_3)_3$Cl—; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrinse Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odour control performance. Solubilized, water-soluble cyclodextrin can exhibit more efficient odour control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar U.S.A., Inc. and Wacker Chemicals (U.S.A.), Inc.

In embodiments mixtures of cyclodextrins are used.

"Odour blockers" can be used as an anti-malodour agent to mitigate the effects of malodours. Non-limiting examples of odour blockers include 4-cyclohexyl-4-methyl-2-pentanone, 4-ethylcyclohexyl methyl ketone, 4-isopropylcyclohexyl methyl ketone, cyclohexyl methyl ketone, 3-methylcyclohexyl methyl ketone, 4-tert.-butylcyclohexyl methyl ketone, 2-methyl-4-tert.butylcyclohexyl methyl ketone, 2-methyl-5-isopropylcyclohexyl methyl ketone, 4-methylcyclohexyl isopropyl ketone, 4-methylcyclohexyl secbutyl ketone, 4-methylcyclohexyl isobutyl ketone, 2,4-dimethylcyclohexyl methyl ketone, 2,3-dimethylcyclohexyl methyl ketone, 2,2-dimethylcyclohexyl methyl ketone, 3,3-dimethylcyclohexyl methyl ketone, 4,4-dimethylcyclohexyl methyl ketone, 3,3,5-trimethylcyclohexyl methyl ketone, 2,2,6-trimethylcyclohexyl methyl ketone, 1-cyclohexyl-1-ethyl formate, 1-cyclohexyl-1-ethyl acetate, 1-cyclohexyl-1-ethyl propionate, 1-cyclohexyl-1-ethyl isobutyrate, 1-cyclohexyl-1-ethyl n-butyrate, 1-cyclohexyl-1-propyl acetate, 1-cyclohexyl-1-propyl n-butyrate, 1-cyclohexyl-2-methyl-1-propyl acetate, 2-cyclohexyl-2-propyl acetate, 2-cyclohexyl-2-propyl propionate, 2-cyc10hexyl-2-propyl isobutyrate, 2-cyclohexyl-2-propyl nbutyrate, 5,5-dimethyl-1,3-cyclohexanedione (dimedone), 2,2-dimethyl-1,3-dioxane-4,6-dione (Meldrum's acid), spiro-[4.5]-6,1 0-dioxa-7,9-dioxodecane, spiro-[5.5]-1,5-dioxa-2,4-dioxoundecane, 2,2-hydroxymethyl-1,3-dioxane-4,6-dione and 1,3-cyclohexadione. Odour blockers are disclosed in more detail in U.S. Pat. Nos. 4,009,253; 4,187,251; 4,719,105; 5,441,727; and U.S. Pat. No. 5,861,371, incorporated herein by reference.

Reactive aldehydes can be used as anti-malodour agent to mitigate the effects of malodours. Examples of suitable reactive aldehydes include Class I aldehydes and Class II aldehydes. Examples of Class I aldehydes include anisic aldehyde, o-allyl-vanillin, benzaldehyde, cuminic aldehyde, ethylaubepin, ethyl-vanillin, heliotropin, tolyl aldehyde, and vanillin. Examples of Class II aldehydes include 3-(4'-tert.butylphenyl)propanal, 2-methyl-3-(4'-tertbutylphenyl) propanal, 2-methyl-3-(4'-isopropylphenyl)propanal, 2,2-dimethyl-3-(4-ethylphenyl)propanal, cinnamic aldehyde, a-amyl-cinnamic aldehyde, and a-hexyl-cinnamic aldehyde. These reactive aldehydes are described in more detail in U.S. Pat. No. 5,676,163. Reactive aldehydes, when used, can include a combination of at least two aldehydes, with one aldehyde being selected from acyclic aliphatic aldehydes, non-terpenic aliphatic aldehydes, non-terpenic alicyclic aldehydes, terpenic aldehydes, aliphatic aldehydes substituted by an aromatic group and bifunctional aldehydes; and the second aldehyde being selected from aldehydes possessing an unsaturation alpha to the aldehyde function conjugated with an aromatic ring, and aldehydes in which the aldehyde group is on an aromatic ring. This combination of at least two aldehydes is described in more detail in WO 00/49120. As used herein, the term "reactive aldehydes" further encompasses deodourizing materials that are the reaction products of (i) an aldehyde with an alcohol, (ii) a ketone with an alcohol, or (iii) an aldehyde with the same or different aldehydes. Such deodourizing materials can be: (a) an acetal or hemiacetal produced by means of reacting an aldehyde with a carbinol; (b) a ketal or hemiketal produced by means of reacting a ketone with a carbinol; (c) a cyclic triacetal or a mixed cyclic triacetal of at least two aldehydes, or a mixture of any of these acetals, hemiacetals, ketals, hemiketals, or cyclic triacetals. These deodorizing perfume materials are described in more detail in WO 01/07095 incorporated herein by reference.

Flavanoids can also be used as anti-malodour agent. Flavanoids are compounds based on the C6-C3-C6 flavan skeleton. Flavanoids can be found in typical essential oils. Such oils include essential oil extracted by dry distillation from needle leaf trees and grasses such as cedar, Japanese cypress, eucalyptus, Japanese red pine, dandelion, low striped bamboo and cranesbill and can contain terpenic material such as alpha-pinene, beta-pinene, myrcene, phencone and camphene. Also included are extracts from tea leaf. Descriptions of such materials can be found in JP 02284997 and JP 04030855 incorporated herein by reference.

Metallic salts can also be used as anti-malodour agents for malodour control benefits. Examples include metal salts of fatty acids. Ricinoleic acid is a preferred fatty acid. Zinc salt is a preferred metal salt. The zinc salt of ricinoleic acid is especially preferred. A commercially available product is TEGO Sorb A30 ex Evonik. Further details of suitable metallic salts is provided below.

Zeolites can be used as anti-malodour agent. A useful class of zeolites is characterized as "intermediate" silicate/aluminate zeolites. The intermediate zeolites are characterized by $SiO_2/AlO_2$ molar ratios of less than about 10. Preferably the molar ratio of $SiO_2/AlO_2$ ranges from about 2 to about 10. The intermediate zeolites can have an advantage over the "high" zeolites. The intermediate zeolites have a higher affinity for amine-type odours, they are more weight efficient for odour absorption because they have a larger surface area, and they are more moisture tolerant and retain more of their odour absorbing capacity in water than the high zeolites. A wide variety of intermediate zeolites suitable for use herein are commercially available as Valfor® CP301-68, Valfor® 300-63, Valfor® CP300-35, and Valfor® CP300-56, available from PQ Corporation, and the CBV100® series of zeolites from Conteka. Zeolite materials marketed under the trade name Abscents® and Smellrite®, available from The Union Carbide Corporation and UOP are also preferred. Such materials are preferred over the intermediate zeolites for control of sulfur-containing odours, e.g., thiols, mercaptans. Suitably the zeolite material has a particle size of less than about 10 microns and is present in the garment refreshing composition at a level of less than about 1% by weight of the garment refreshing composition.

Activated carbon is another suitable anti-malodour agent. Suitable carbon material is a known absorbent for organic molecules and/or for air purification purposes. Often, such carbon material is referred to as "activated" carbon or "activated" charcoal. Such carbon is available from commercial sources under such trade names as; Calgon-Type CPG®;Type PCB®;Type SGL®;Type CAL®;and Type OL®. Suitably the activated carbon preferably has a particle size of less than about 10 microns and is present in the garment refreshing composition at a level of less than about 1% by weight of the garment refreshing composition.

Exemplar anti-malodour agents are as follows.

ODOBAN™ is manufactured and distributed by Clean Central Corp. of Warner Robins, Ga. Its active ingredient is alkyl (C14 50%, C12 40% and C16 10%) dimethyl benzyl ammonium chloride which is an antibacterial quaternary ammonium compound. The alkyl dimethyl benzyl ammonium chloride is in a solution with water and isopropanol. Another product by Clean Control Corp. is BIOODOUR CONTROL™ which includes water, bacterial spores, alkylphenol ethoxylate and propylene glycol.

ZEOCRYSTAL FRESH AIR MIST™ is manufactured and distributed by Zeo Crystal Corp. (a/k/a American Zeolite Corporation) of Crestwood, Ill. The liquid comprises chlorites, oxygen, sodium, carbonates and citrus extract, and may comprise zeolite.

The odour control agent may comprise a "malodour counteractant" as described in US2005/0113282A1 by which is hereby incorporated by reference. In particular this malodour counteractant may comprise a mixture of zinc ricinoleate or a solution thereof and a substituted monocyclic organic compound as described at page 2, paragraph 17 whereby the substituted monocyclic organic compound is in the alternative or in combination one or more of:

1-cyclohexylethan-1-yl butyrate;

1-cyclohexylethan-1-yl acetate;

1-cyclohexylethan-1-ol;

1-(4'-methylethyl) cyclohexylethan-1-yl propionate; and

2'-hydroxy-$1^1$-ethyl(2-phenoxy)acetate.

Synergistic combinations of malodour counteractants as disclosed at paragraphs 38-49 are suitable, for example, the compositions comprising:

(i) from about 10 to about 90 parts by weight of at least one substituted monocyclic organic compound-containing material which is:

(a)

1-cyclohexylethan-1-yl butyrate having the structure:

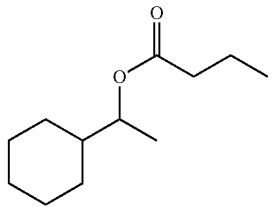

-continued (b) 1-cyclohexylethan-1-yl acetate having the structure:

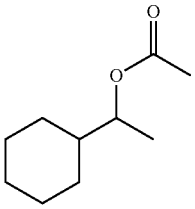

(c) 1-cyclohexylethan-1-ol having the structure:

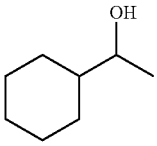

(d) 1-(4′-methylethyl)cyclohexylethan-1-yl propionate having the structure:

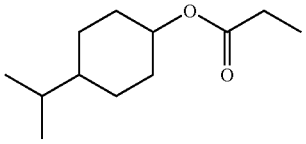

and (e) 2′-hydroxy-1′-ethyl(2-phenoxy)acetate having the structure:

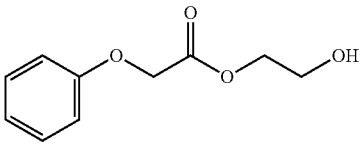

and (ii) from about 90 to about 10 parts by weight of a zinc ricinoleate-containing composition which is zinc ricinoleate and/or solutions of zinc ricinoleate containing greater than about 30% by weight of zinc ricinoleate. Preferably, the aforementioned zinc ricinoleate-containing compositions are mixtures of about 50% by weight of zinc ricinoleate and about 50% by weight of at least one 1-hydroxy-2-ethoxyethyl ether of a More specifically, a preferred composition useful in combination with the zinc ricinoleate component is a mixture of:

(A) 1-cyclohexylethan-1-yl butyrate;

(B) 1-cyclohexylethan-1-yl acetate; and (C) 1-(4'-methylethyl)cyclohexylethan-l-yl propionate.

More preferably, the weight ratio of components of the immediately-aforementioned zinc riconoleate-containing mixture is one where the zinc ricinoleate-containing composition: 1-cyclohexylethan-1-yl butyrate: 1-cyclohexylethan-1-yl acetate: 1-(4'-methylethyl)-cyclohexylethan-1-yl propionate is about 2:1:1:1.

Another preferred composition useful in combination with the zinc ricinoleate component or solution is a mixture of:

(A) 1-cyclohexylethan-1-yl acetate; and (B) 1-(4'-methylethyl)cyclohexylethan-l-yl propionate.

More preferably, the weight ratio of components of the immediately-aforementioned zinc riconoleate mixture is one where the zinc ricinoleate-containing composition: 1-cyclohexylethan-1-yl acetate: 1-(4'-methylethyl)cyclohexylethan-l-yl propionate is about 3:1:1.

The anti-malodour materials of the present invention may be 'free' in the composition or they may be encapsulated. Suitable encapsulating material, may comprise, but are not limited to; aminoplasts, proteins, polyurethanes, polyacrylates, polymethacrylates, polysaccharides, polyamides, polyolefins, gums, silicones, lipids, modified cellulose, polyphosphate, polystyrene, polyesters or combinations thereof.

Particularly preferred encapsulaing materials are aminoplasts, such as melamine formaldehyde or urea formaldehyde. The microcapsules of the present invention can be friable microcapsules and/or moisture activated microcapsules. By friable, it is meant that the perfume microcapsule will rupture when a force is exerted. By moisture activated, it is meant that the perfume is released in the presence of water.

To the extent any material described herein as an odour control agent might also be classified as another component described herein, for purposes of the present invention, such material shall be classified as an odour control agent.

Other Optional Ingredients

Other optional ingredients may be present in the aqueous spray compositions of the present invention. For example the aqueous spray compositions may further comprise: colourants/dyes, preservatives, viscosity control agents, microcapsules comprising benefit agents, structurants/dispersants, solvents, antifoams for processing aid etc.

Spray Compositions

The compositions are fabric spray compositions. By this is meant that the compositions are suitable for spraying onto a fabric. They may be sprayed by any suitable spraying device.

Preferably the spray device is a manually operable spray device in the sense that the spray mechanism is manually operable to discharge a dose of said composition from the nozzle. The spray mechanism may be operated by an actuator. The actuator can be a push actuator or a pull actuator. The actuator may comprise a trigger. The spray mechanism may comprise a hand-operable pump. Optionally, said pump is one of: a positive displacement pump; a self-priming pump; a reciprocating pump. Suitable spray devices include trigger sprays, continuous/semi-continuous sprays, finger pump sprays, vibrating mesh device output sprays.

Preferably the spray device is operable without the use of a propellant. Indeed, propellant-free spray devices are preferred. This allows the spray to maintain the integrity and purity of the product, uncontaminated with propellant and is preferably environmentally.

Preferably the spray device is pressurised. This can improve spray duration and velocity. Preferably the spray device is pressurised by a gas chamber, separate from the reservoir containing the composition. The gas is preferably air or nitrogen. The spray device may comprise an outer container containing the composition and a pressurizing agent, wherein the composition is segregated from the pressurizing agent by containment (preferably hermetically sealed) in a flexible pouch. This which maintains complete formulation integrity so that only pure (i.e. excludes pressurising agent) composition is dispensed. Preferred systems are the so-called 'bag-in-can' (or BOV, bag-on-valve technology). Alternatively the spray device may comprise piston barrier mechanism, for example EarthSafe by Crown Holdings.

Preferably the spray device comprises a biodegradable plastic material.

The spray mechanism may further comprise an atomiser configured to break up said liquid dose into droplets and thereby facilitate creation of said fine aerosol in the form of a mist. Conveniently, said atomiser may comprise at least one of: a swirl chamber and a lateral dispersion chamber. Suitably, the atomiser functions to mix air with the aqueous fabric spray composition.

The particle size of the formulation when sprayed is preferably no more than 300 μm, preferably no more than 250 μm, preferably no more than 150 μm, preferably no more than 125 μm, preferably no more than 100 μm. The particle size of the formulation when sprayed is preferably at least 5 μm, preferably at least 10 μm, preferably at least 15 μm, preferably at least 20 μm, preferably at least 30 μm, preferably at least 40 μm. Suitably the spray comprises droplets having an average diameter in the range of preferably 5 to 300 μm, more preferably 10 to 250 μm, most preferably 15 to 150 μm. This size allows for homogeneous distribution and a balance between sufficient wetting of the fabric, without potential fabric damage caused by excessive dosing of certain ingredients. Droplet size may be measured on a Malvern Spraytec instrument, with the peak maximum corresponding to the average droplet size. The parameter droplet size is the volume mean diameter, D[4,3].

Suitably, following actuation, the spray has a duration in the range of at least 0.4 seconds. Preferably the spray has a duration of at least 0.8 seconds. A longer duration minimises the effort by maximising coverage per actuation of a spray device. This is an important factor for products designed to be used over the full area of garments. Preferably the spray duration is directly linked to actuation such that the spray output continues only as long as the actuator is activated (e.g. as long as a button or trigger is pressed).

Spray reservoirs may be non-pressurised, manually or mechanically pre-pressurised devices. The above also to removable/refillable reservoirs.

According to a further aspect of the present invention, there is provided a replacement reservoir for a garment refresh product according to the above aspect(s), the replacement reservoir being pre-filled with a volume of said garment refreshing composition for replenishment of said product. A suitable "refill kit" comprises one or more reservoirs. In the case of more than one reservoir, for example two, three, four, five, or more reservoirs, the contents (aqueous fabric spray composition) of each reservoir may the same as or different from the other reservoirs.

Dose

Conveniently, the garment refreshing composition is provided as a liquid, and said spray mechanism is operable to discharge a dose of at least 0.1 ml, preferably at least 0.2 ml, more preferably at least 0.25 ml, more preferably at least 0.3 ml, more preferably at least 0.35 ml, more preferably at least 0.35 ml, more preferably at least 0.4 ml, more preferably at least 0.45 ml, and most preferably at least 0.5 ml.

Suitably the dose is no more than 2 ml, preferably no more than 1.8 ml, preferably no more than 1.6 ml, more preferably no more than 1.5 ml, more preferably no more than 1.4 ml, more preferably no more than 1.3 ml, and most preferably no more than 1.2 ml.

Suitably the dose is between 0.1 and 2 ml of said liquid garment refreshing composition, preferably between 0.2 and 1.8 ml, more preferably 0.25 to 1.6 ml, more preferably 0.25 to 1.5 ml, and most preferably 0.25 to 1.2 ml.

These doses have been found to be particularly effective at achieving the desired garment refresh effect (for example anti-wrinkle) without unsightly and wasteful large droplet formation.

Methods of Use

In one aspect of the present invention, there is provided a method of rejuvenating fabric or returning clothes to a 'just washed' state. 'Just washed' state is intended to mean the look, feel and smell of a recently laundered garment, for some garments the laundry process will include ironing (e.g. shirts). The method according to the present invention comprises the step of spraying the composition of the present invention onto a garment.

Use of the Composition

In one aspect of the present invention, there is provided a use of the composition according to the present invention. The composition may be used to rejuvenate clothes or to return garments to a 'just washed state'.

By rejuvenate it is meant that the composition may be used to make the treated garment look and feel younger or newer. This includes restoring the garments to the look and feel of a newly purchased state, which may include: less faded colours or a thicker feel or split fibre protection or sticking down of fibrils etc. in particular shape restoration.

By returning to a 'just washed state' it is meant that the composition may be used to make the garments look, feel and smell recently laundered. This includes providing the feeling of rigidity and crispness, or removing unwanted creases, removal of stretching or bagging etc.

Example Formulation

| Ingredient | Composition 1 (w.t. % of active ingredient) | Composition 2 (w.t. % of active ingredient) |
|---|---|---|
| Amino silicone (pre emulsified) | — | 1.5 |
| PDMS (pre emulsified) | 1.5 | — |
| Free oil perfume | 0.34 | 0.34 |
| Malodour counteractant | 0.2 | 0.2 |
| PEG-40 hydrogenated caster oil (non-ionic surfactant) | 0.8 | 0.8 |
| Minors and water | To 100 | To 100 |

Method of Manufacture:

A vessel was charged with water and maintained at 20° C.±5° C. To the vessel was added the silicone emulsion and minors, with stirring. A pre-mix was produced by blending melted non-ionic surfactant (45° C.) with the free oil perfume and anti-malodour technology whilst keeping this blend at 45° C. The premix was then added to the vessel with mixing.

The invention claimed is:

1. A fabric spray composition, comprising:

1 to 10 w.t. % silicone, wherein the silicone is in the form of a first emulsion having a particle size of 1 nm to 150 nm; and free perfume, wherein the free perfume is in the form of a second emulsion having a particle size of 1 nm to 30 μm, wherein the fabric spray composition is aqueous, and the silicone is selected from the group consisting of carboxy functionalised silicone, anionic functionalised silicone, non-functionalised silicone, and mixtures thereof.

2. The composition according to claim 1, wherein the composition comprises 0.0001 to 10 w.t. % free perfume.

3. The composition according to claim 1, wherein the composition further comprises a malodour ingredient.

4. The composition according to claim 1, wherein the free perfume composition comprises at least 10 w.t. % blooming perfume ingredients.

5. The composition according to claim 1, wherein the silicone has a molecular weight of 1,000 to 500,000.

6. The composition according to claim 1, wherein the silicone comprises functionalised silicone.

7. The composition according to claim 6, wherein the functional group(s) on the functionalised silicone are located in pendent positions on the silicone chain.

8. The composition according to claim 1, wherein the silicone comprises non-functionalised silicone.

9. The composition according to claim 8, wherein the non-functionalised silicone is according to the formula:

$$R_1—Si(R_3)_2—O—[—Si(R_3)_2—O—]_x—Si(R_3)_2—R_2$$

R1=hydrogen, methyl, methoxy, ethoxy, hydroxy, propoxy, and aryloxy group;

R2=hydrogen, methyl, methoxy, ethoxy, hydroxy, propoxy, and aryloxy group; and

R3=alkyl, aryl, hydroxy, or hydroxyalkyl group, and mixtures thereof.

10. The composition according to claim 1, wherein the silicone composition comprises a polydimethylsiloxane polymer.

11. A method of rejuvenating fabric, the method comprising:

spraying a composition onto the fabric, wherein the composition comprises:

1 to 10 w.t. % silicone, wherein the silicone is in the form of a first emulsion having a particle size of 1 nm to 150 nm; and free perfume, wherein the free perfume is in the form of a second emulsion having a particle size of 1 nm to 30 μm, wherein the fabric spray composition is aqueous, and the silicone is selected from the group consisting of carboxy functionalised silicone, anionic functionalised silicone, non-functionalised silicone, and mixtures thereof.

* * * * *